US008235563B2

(12) United States Patent
Zheng

(10) Patent No.: US 8,235,563 B2
(45) Date of Patent: Aug. 7, 2012

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 240 days.

(21) Appl. No.: 12/723,708

(22) Filed: Mar. 15, 2010

(65) Prior Publication Data

US 2011/0128746 A1 Jun. 2, 2011

(30) Foreign Application Priority Data

Nov. 30, 2009 (CN) ..... 2009 1 0310700

(51) Int. Cl.
*F21V 29/00* (2006.01)

(52) U.S. Cl. ..... 362/373; 362/294; 362/270

(58) Field of Classification Search ..... 362/249.02, 362/294, 373, 368, 370
See application file for complete search history.

(56) References Cited

U.S. PATENT DOCUMENTS

| | | | | |
|---|---|---|---|---|
| 4,329,030 | A * | 5/1982 | Aihara et al. | 396/251 |
| 7,744,247 | B2 * | 6/2010 | Zhang et al. | 362/249.02 |
| 7,789,528 | B2 * | 9/2010 | Mo et al. | 362/249.02 |
| 7,794,116 | B2 * | 9/2010 | Shuai et al. | 362/294 |
| 8,007,128 | B2 * | 8/2011 | Wu et al. | 362/249.02 |

* cited by examiner

*Primary Examiner* — Robert May
(74) *Attorney, Agent, or Firm* — Altis Law Group, Inc.

(57) ABSTRACT

An LED lamp includes a bracket and an LED module. The bracket includes a mounting body configured for fixing the LED lamp at a desired position and a heat dissipation portion extending from the body. The LED module includes a circuit board thermally attached to the heat dissipation portion and an LED connected to the circuit board. A lamp cover is secured to the heat dissipation portion and covers the LED module.

14 Claims, 3 Drawing Sheets

LED LAMP

BACKGROUND

1. Technical Field

The present disclosure relates to LED (light emitting diode) lamps, and more particularly to an LED lamp having a low energy consumption.

2. Description of Related Art

Conventional light sources, such as fluorescent lamp, halogen lamp and incandescent lamp need large power consumption. It is environmentally unfriendly and energy consumptive.

It is thus desirable to provide an LED lamp which can overcome the described limitations.

DETAILED DESCRIPTION

Figure 1:
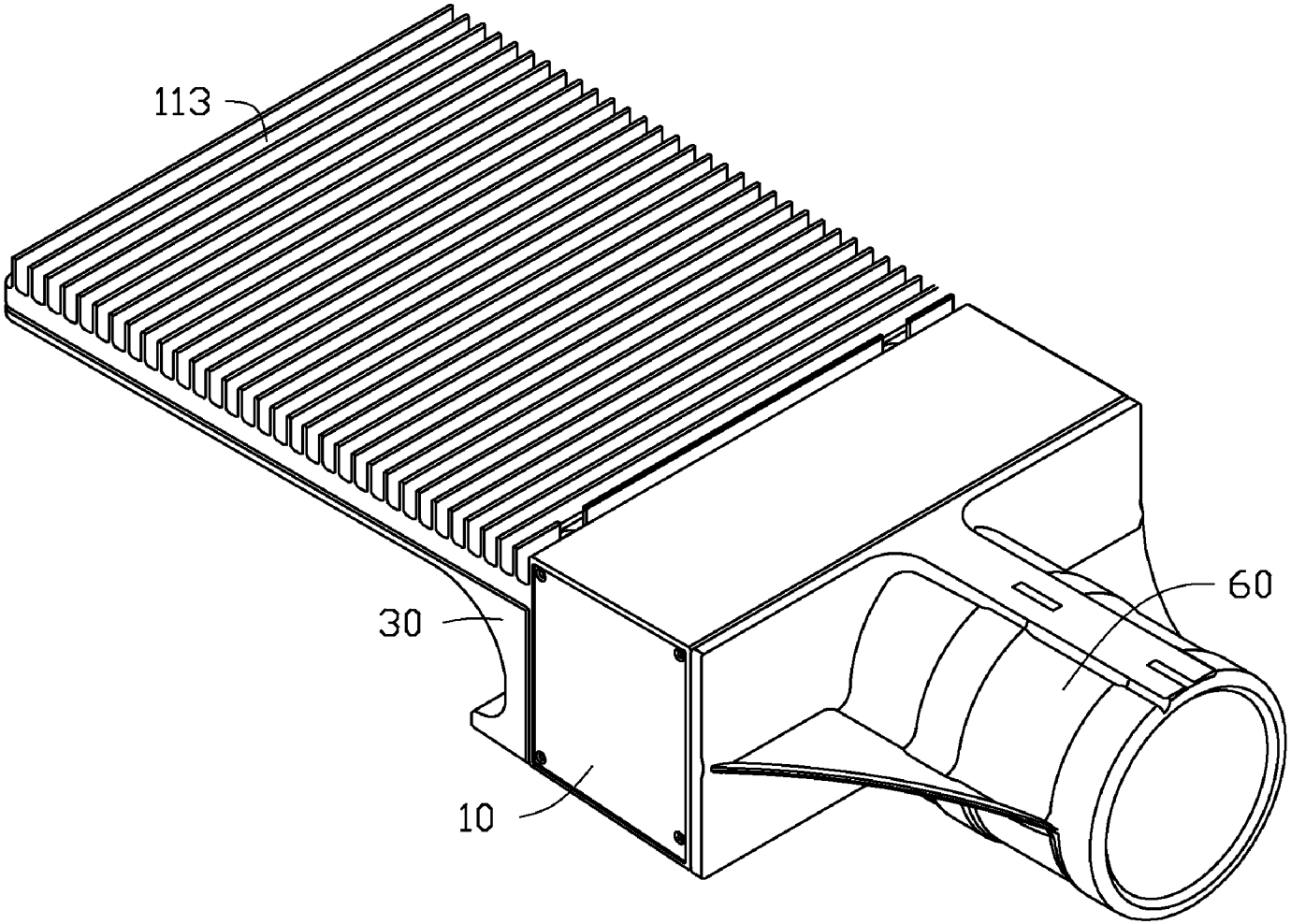
FIG. 1 is an assembled view of an LED lamp according to an embodiment of the present disclosure.
Figure 2:
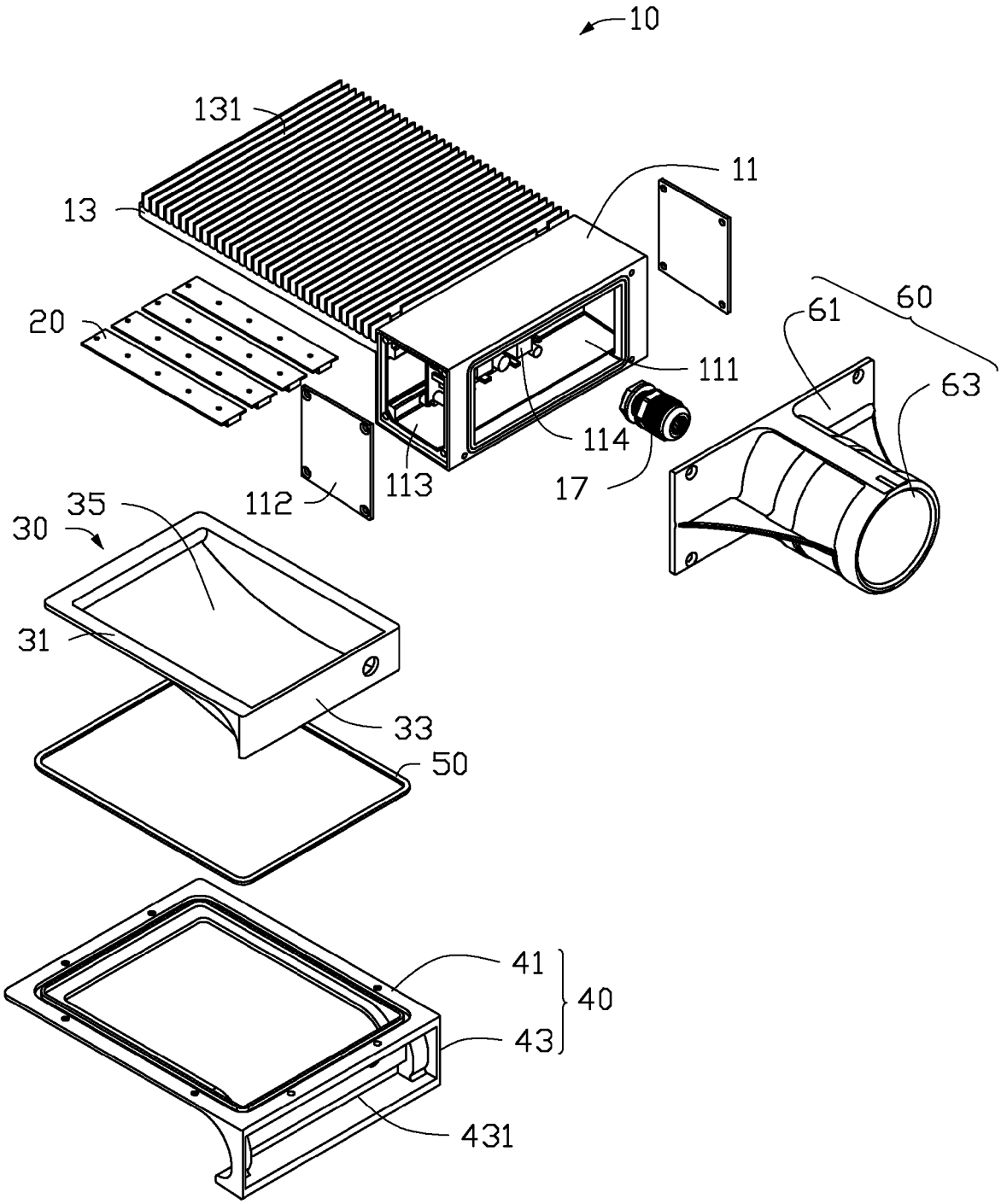
FIG. 2 is an exploded view of the LED lamp of FIG. 1.

Referring to FIGS. 1-2, an LED lamp according to an embodiment includes a bracket 10, an LED module 20 thermally contacting the bracket 10, a lamp cover 30 connected to the bracket 10 and encapsulating the LED module 20, a securing member 40 engaging with the lamp cover 30, and a connector 60.

Figure 3:
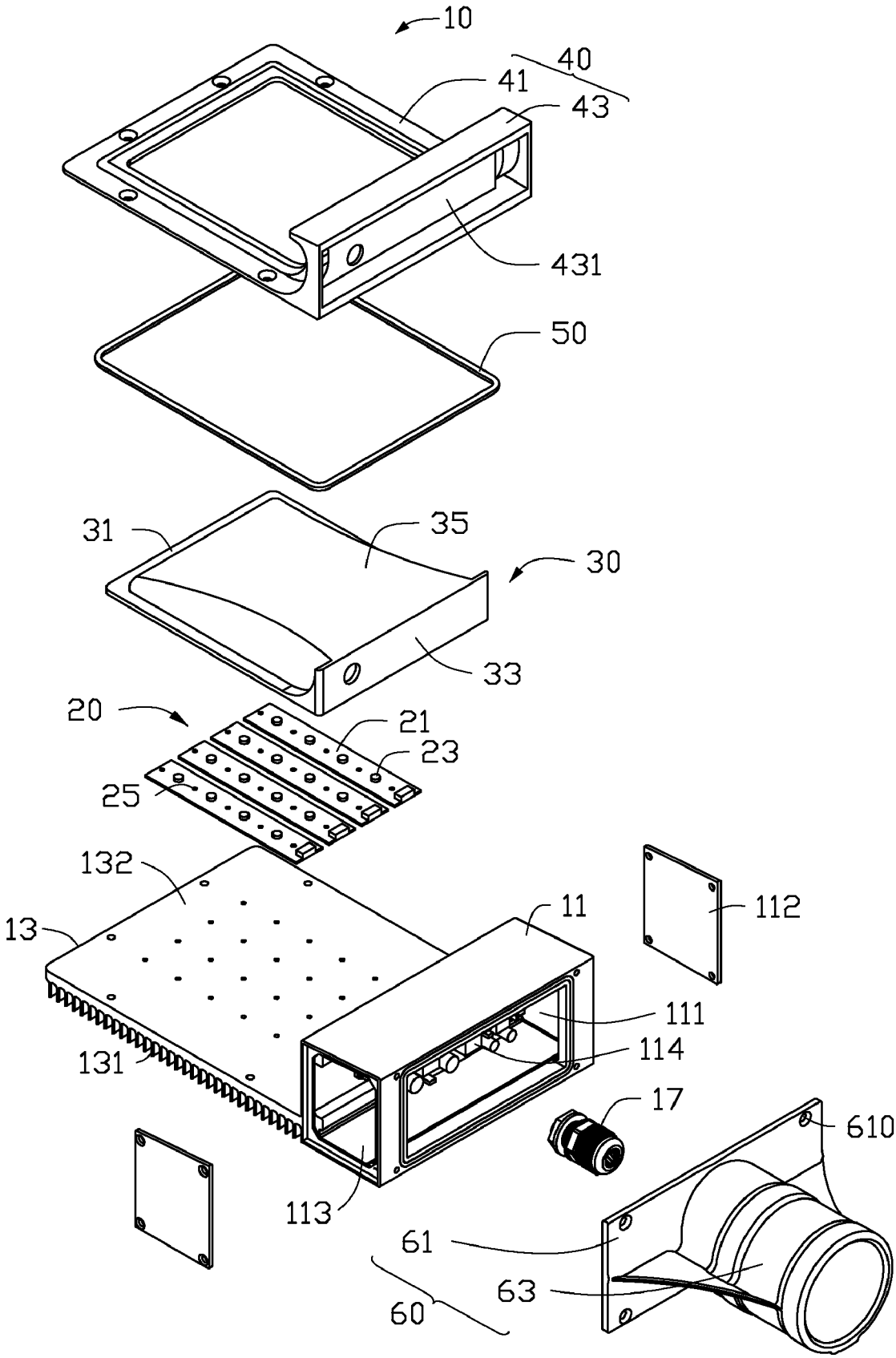
FIG. 3 is an inverted view of the LED lamp of FIG. 2.

Referring also to FIG. 3, the bracket 10 is formed by metal extrusion such as aluminum extrusion and has an L-shaped configuration. The bracket 10 includes a cuboidal body 11 and an elongated, plate-shaped heat dissipation portion 13 extending from a top portion of a rear side of the body 11. A plurality of spaced fins 131 extends upwardly from a top surface of the heat dissipation portion 13 to dissipate heat of the heat dissipation portion 13 absorbed from the LED module 20. In this embodiment, top ends of the fins 131 and a top surface of the body 11 are coplanar.

The body 11 is a hollow member, and defines a first opening 111 at a front end thereof, and two second opening 113 at lateral ends thereof. Two sidewalls 112 are respectively fixed to the lateral ends of the body 11 to seal the second openings 113. A driving circuit module 114 is received in the body 11 and electrically connects the LED module 20.

The connecter 60 includes an elongated baffling plate 61 and a hollow, cylindrical holder 63 extending forwardly from a central portion of the baffling plate 61. Through holes 610 are defined in corners of the baffling plate 61 for screws extending therethough to assemble the connector 60 to the front end of the body 11 and thus to seal the first opening 111. The holder 63 is used to connect with a lamp pole (not shown), thus to fix the LED lamp at a desired position. A waterproof, hollow plug 17 is received in the holder 63 and extends through the baffling plate 61 to allow wires extending therethrough to electrically connect the driving circuit module 114, thereby supplying electric current of an external power source to the LED module 20.

The LED module 20 attaches to a bottom surface 132 of the heat dissipation portion 13. The LED module 20 includes a circuit board 21 and a plurality of LEDs 23 fixedly and electrically connected to the printed circuit board 21. A plurality of fixing holes 25 are defined in the circuit board 21 for fixing the LED module 20 to the bottom surface 132 of the heat dissipation portion 13.

The lamp cover 30 includes a hollow frame 31, a connecting plate 33 extending downwardly from a front end of the frame 31, and a bent cover 35 connecting the frame 31 and the connecting plate 33. The frame 31 has a profile similar to that of the heat dissipation portion 13, but has a length and width both being smaller than the heat dissipation portion 13. The frame 31 is secured to the bottom surface 132 of the heat dissipation portion 13 at a position surrounding the circuit board 21 of the LED module 20. An outer periphery of the bottom surface 132 of the heat dissipation portion 13 around the frame 31 is exposed for fixing the securing member 40. A size of the connecting plate 33 is smaller than that of the rear side of the body 11 of the bracket 10. The connecting plate 33 is secured on the rear side of the body 11, below the heat dissipation portion 13. The cover 35 is a transparent, and concaves downwardly from the frame 31. A front side of the cover 35 is connected with a bottom edge of the connecting plate 33. The lamp cover 30 and the bracket 10 cooperatively form a hermetical chamber (not labeled) to receive the LED module 20 therein. A depth of the chamber increases from a rear end of the heat dissipation portion 13 to a front end of the heat dissipation portion 13. The cover 35 faces, spaces from and covers the LED module 20.

The securing member 40 is similar to the lamp cover 30 in configuration, and includes a rectangular, hollow first securing portion 41 and a rectangular, hollow second securing portion 43. The first securing portion 41 perpendicularly extends from a top end of the second securing portion 43 along a horizontal direction. The second securing portion 43 defines a rectangular opening 431 corresponding to the connecting plate 33. The first securing portion 41 presses the frame 31 of the lamp cover 30. The second securing portion 43 presses the connecting plate 33. Fasteners (not shown) extend through the first securing portion 41 and engage with the heat dissipation portion 13 to assemble the lamp cover 30 on the bracket 10. A gasket 50 is sandwiched between the frame 31 and the first securing portion 41 to enhance a hermeticity of the chamber defined by the bracket 10 and the lamp cover 30.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a bracket comprising a body configured for fixing the LED lamp at a desired position and a heat dissipation portion extending from the body;

an LED module comprising a circuit board thermally attached to the heat dissipation portion and an LED connected to the circuit board; and a lamp cover connected to the heat dissipation portion of the bracket and covering the LED module;

wherein a space is heremetically defined between the heat dissipation portion and the lamp cover to receive the LED module therein, and the space has a depth which is gradually increased from an end of the heat dissipation portion remote from the body of the bracket to an end of the heat dissipation portion adjacent to the body.

2. The LED lamp of claim 1, wherein a plurality of fins extends outwardly the heat dissipation portion, the tins and the LED module being arranged at opposite sides of the heat dissipation portion.

3. The LED lamp of claim 2, wherein the body of the bracket is hollow and receives a driving circuit module therein, the driving circuit module configured for electrically connecting the LED module to a power source.

4. The LED lamp of claim 3 further comprising a connecter fixed on the body for wires extending therethrough to connect the driving circuit module with the power source.

5. The LED lamp of claim 4, wherein the connecter comprises a baffling plate fixed on the body and a hollow holder extending from the baffling plate.

6. The LED lamp of claim 5, further comprising a waterproof, hollow plug received in the holder and extending through the baffling plate to allow the wires extending therethrough to electrically connect the driving circuit module with the power source.

7. The LED lamp of claim 1, wherein the lamp cover comprises a frame connected to the heat dissipation portion of the bracket, a connecting plate extending downwardly from an end of the frame and connected to the body of the bracket, and a light permeable cover connecting the frame and the connecting plate, the light permeable cover facing the LED module.

8. The LED lamp of claim 7, further comprising a securing member abutting against the lamp cover and engaging with the bracket.

9. The LED lamp of claim 8, wherein the securing member comprises a hollow first securing portion engaging with the frame of the lamp cover and a hollow second securing portion engaging with the connecting plate of the lamp cover.

10. An LED lamp comprising:

a bracket comprising a body configured for fixing the LED lamp at a desired position and a heat dissipation portion extending from the body;

an LED module comprising a circuit board thermally attached to the heat dissipation portion and an LED connected to the circuit board;

a lamp cover connected to the heat dissipation portion of the bracket and covering the LED module, the lamp cover comprising a frame connected to the heat dissipation portion of the bracket, a connecting plate extending downwardly from an end of the frame and connected to the body of the bracket, and a light permeable cover connecting the frame and the connecting plate, the light permeable cover facing the LED module; and a securing member abutting against the lamp cover and engaging with the bracket;

wherein the securing member comprises a hollow first securing portion engaging with the frame of the lamp cover and a hollow second securing portion engaging with the connecting plate of the lamp cover.

11. The LED lamp of claim 10, wherein a plurality of fins extends outwardly the heat dissipation portion, the fins and the LED module being arranged at opposite sides of the heat dissipation portion.

12. The LED lamp of claim 10, wherein the body of the bracket is hollow and receives a driving circuit module therein.

13. The LED lamp of claim 10, wherein the heat dissipation portion is an elongated plate and the body is cubical.

14. The LED lamp of claim 10, wherein a baffling plate is fixed on a side of the body and a hollow holder extends from the baffling plate.

* * * * *